US007648594B2

(12) United States Patent
Higashi et al.

(10) Patent No.: US 7,648,594 B2
(45) **Date of Patent: *Jan. 19, 2010**

(54) EXTRUDED ALUMINUM ALLOY WHICH EXCELS IN MACHINABILITY, CAULKING PROPERTIES, AND WEAR RESISTANCE

(75) Inventors: Nobuyuki Higashi, Toyama (JP); Kinji Hashimoto, Toyama (JP)

(73) Assignee: Aisin Keikinzoku Co., Ltd. (JP)

( * ) Notice: Subject to any disclaimer, the term of this patent is extended or adjusted under 35 U.S.C. 154(b) by 337 days.

This patent is subject to a terminal disclaimer.

(21) Appl. No.: 11/651,841

(22) Filed: Jan. 10, 2007

(65) Prior Publication Data

US 2007/0107812 A1 May 17, 2007

Related U.S. Application Data

(63) Continuation of application No. 11/121,150, filed on May 3, 2005, now Pat. No. 7,175,719, which is a continuation of application No. PCT/JP03/11167, filed on Sep. 1, 2003.

(51) Int. Cl.
*C22C 21/02* (2006.01)

(52) U.S. Cl. ..... 148/440; 420/534; 420/535; 420/546

(58) Field of Classification Search ..... 148/417, 148/439, 440; 420/534, 535, 544, 546
See application file for complete search history.

(56) References Cited

U.S. PATENT DOCUMENTS

| | | | | |
|---|---|---|---|---|
| 6,716,390 | B2 | 4/2004 | Bekki et al. | |
| 7,175,719 | B2 * | 2/2007 | Higashi et al. | 148/440 |
| 7,473,327 | B2 * | 1/2009 | Takase et al. | 148/417 |
| 2004/0223869 | A1 | 11/2004 | Takase et al. | |

FOREIGN PATENT DOCUMENTS

| | | |
|---|---|---|
| JP | 09-176769 | 7/1997 |
| JP | 2002-047524 | 2/2002 |

OTHER PUBLICATIONS

"Aluminum and Aluminum Alloys", ASM International, 1993, pp. 29-30.

* cited by examiner

*Primary Examiner*—Roy King
*Assistant Examiner*—Janelle Morillo
(74) *Attorney, Agent, or Firm*—Harness, Dickey & Pierce, P.L.C.

(57) ABSTRACT

Extruded aluminum alloy which excels in machinability, caulking properties, and wear resistance, the extruded aluminum alloy including 3.0 to 6.0 mass % of Si, 0.1 to 0.45 mass % of Mg, 0.01 to 0.5 mass % of Cu, 0.01 to 0.5 mass % of Mn, and 0.40 to 0.90 mass % of Fe, with the balance being Al and unavoidable impurities.

2 Claims, 4 Drawing Sheets

| | NO. | Component (mass%) | | | | | | | |
|---|---|---|---|---|---|---|---|---|---|
| | | Si | Fe | Cu | Mn | Mg | Cr | Zn | Ti |
| Extruded aluminum alloy of invention | 1 | 4.71 | 0.38 | 0.15 | 0.10 | 0.41 | 0.10 | 0.00 | 0.03 |
| | 2 | 4.67 | 0.68 | 0.15 | 0.10 | 0.39 | 0.11 | 0.00 | 0.03 |
| | 3 | 4.57 | 0.92 | 0.15 | 0.11 | 0.40 | 0.10 | 0.00 | 0.03 |
| | 4 | 4.62 | 0.51 | 0.15 | 0.10 | 0.31 | 0.10 | 0.00 | 0.03 |
| | 5 | 4.58 | 0.52 | 0.15 | 0.10 | 0.35 | 0.10 | 0.00 | 0.03 |
| | 6 | 4.63 | 0.49 | 0.15 | 0.10 | 0.44 | 0.10 | 0.00 | 0.03 |
| | 7 | 4.57 | 0.45 | 0.15 | 0.10 | 0.39 | 0.10 | 0.00 | 0.03 |
| | 8 | 4.60 | 0.50 | 0.15 | 0.10 | 0.39 | 0.10 | 0.00 | 0.03 |
| | 9 | 4.61 | 0.55 | 0.15 | 0.10 | 0.39 | 0.10 | 0.00 | 0.03 |
| | 10 | 4.59 | 0.60 | 0.15 | 0.10 | 0.39 | 0.10 | 0.00 | 0.03 |
| | 11 | 4.67 | 0.68 | 0.15 | 0.10 | 0.39 | 0.11 | 0.00 | 0.03 |
| | 12 | 4.67 | 0.68 | 0.15 | 0.10 | 0.39 | 0.11 | 0.00 | 0.03 |
| Extruded aluminum alloy for comparison | 13 | 4.61 | 0.29 | 0.13 | 0.09 | 0.41 | 0.02 | 0.09 | 0.03 |
| | 14 | 4.61 | 0.29 | 0.13 | 0.09 | 0.41 | 0.02 | 0.09 | 0.03 |
| | 15 | 4.61 | 0.29 | 0.13 | 0.09 | 0.41 | 0.02 | 0.09 | 0.03 |
| | 16 | 4.38 | 1.20 | 0.19 | 0.10 | 0.40 | 0.10 | 0.00 | 0.03 |
| | 17 | 4.92 | 1.50 | 0.25 | 0.10 | 0.40 | 0.10 | 0.00 | 0.03 |

FIG. 1

| | NO. | Component (mass%) | | | | | | | |
|---|---|---|---|---|---|---|---|---|---|
| | | Si | Fe | Cu | Mn | Mg | Cr | Zn | Ti |
| Extruded aluminum alloy of invention | 1 | 4.71 | 0.38 | 0.15 | 0.10 | 0.41 | 0.10 | 0.00 | 0.03 |
| | 2 | 4.67 | 0.68 | 0.15 | 0.10 | 0.39 | 0.11 | 0.00 | 0.03 |
| | 3 | 4.57 | 0.92 | 0.15 | 0.11 | 0.40 | 0.10 | 0.00 | 0.03 |
| | 4 | 4.62 | 0.51 | 0.15 | 0.10 | 0.31 | 0.10 | 0.00 | 0.03 |
| | 5 | 4.58 | 0.52 | 0.15 | 0.10 | 0.35 | 0.10 | 0.00 | 0.03 |
| | 6 | 4.63 | 0.49 | 0.15 | 0.10 | 0.44 | 0.10 | 0.00 | 0.03 |
| | 7 | 4.57 | 0.45 | 0.15 | 0.10 | 0.39 | 0.10 | 0.00 | 0.03 |
| | 8 | 4.60 | 0.50 | 0.15 | 0.10 | 0.39 | 0.10 | 0.00 | 0.03 |
| | 9 | 4.61 | 0.55 | 0.15 | 0.10 | 0.39 | 0.10 | 0.00 | 0.03 |
| | 10 | 4.59 | 0.60 | 0.15 | 0.10 | 0.39 | 0.10 | 0.00 | 0.03 |
| | 11 | 4.67 | 0.68 | 0.15 | 0.10 | 0.39 | 0.11 | 0.00 | 0.03 |
| | 12 | 4.67 | 0.68 | 0.15 | 0.10 | 0.39 | 0.11 | 0.00 | 0.03 |
| Extruded aluminum alloy for comparison | 13 | 4.61 | 0.29 | 0.13 | 0.09 | 0.41 | 0.02 | 0.09 | 0.03 |
| | 14 | 4.61 | 0.29 | 0.13 | 0.09 | 0.41 | 0.02 | 0.09 | 0.03 |
| | 15 | 4.61 | 0.29 | 0.13 | 0.09 | 0.41 | 0.02 | 0.09 | 0.03 |
| | 16 | 4.38 | 1.20 | 0.19 | 0.10 | 0.40 | 0.10 | 0.00 | 0.03 |
| | 17 | 4.92 | 1.50 | 0.25 | 0.10 | 0.40 | 0.10 | 0.00 | 0.03 |

FIG. 2

| | NO. | Aging | | | Tensile strength (MPa) | 0.2% yield strength | Elongation (%) | Hardness (HRB) |
|---|---|---|---|---|---|---|---|---|
| | | Temperature | Time | Condition | | | | |
| Extruded aluminum alloy of invention | 1 | 185 | 4 | Stable | 308 | 269 | 9.3 | 63 |
| | 2 | 185 | 4 | Stable | 310 | 271 | 9.9 | 61 |
| | 3 | 185 | 4 | Stable | 312 | 272 | 9.1 | 61 |
| | 4 | 185 | 4 | Stable | 307 | 266 | 9.5 | 60 |
| | 5 | 185 | 4 | Stable | 310 | 270 | 9.4 | 59 |
| | 6 | 185 | 4 | Stable | 312 | 274 | 9.3 | 60 |
| | 7 | 185 | 4 | Stable | 310 | 271 | 9.7 | 59 |
| | 8 | 185 | 4 | Stable | 309 | 273 | 9.4 | 59 |
| | 9 | 185 | 4 | Stable | 312 | 275 | 9.2 | 60 |
| | 10 | 185 | 4 | Stable | 308 | 272 | 9.0 | 61 |
| | 11 | 175 | 3 | Under-aging | 311 | 270 | 9.8 | 59 |
| | 12 | 205 | 2 | Over-aging | 309 | 269 | 9.4 | 57 |
| Extruded aluminum alloy for comparison | 13 | 175 | 2 | Under-aging | 312 | 282 | 9.5 | 60 |
| | 14 | 205 | 2 | Over-aging | 309 | 279 | 9.0 | 57 |
| | 15 | 175 | 4 | Stable | 311 | 281 | 9.4 | 59 |
| | 16 | 185 | 4 | Stable | 308 | 267 | 7.2 | 57 |
| | 17 | 195 | 4 | Stable | 329 | 292 | 5.4 | 63 |

FIG. 3

| | NO. | Maximum chip length (mm) | Long chip total length (mm) | Critical upsetting ratio (%) | Mean deformation resistance (N/mm2) |
|---|---|---|---|---|---|
| Extruded aluminum alloy of invention | 1 | 32 | 246 | 38.1 | 385 |
| | 2 | 18 | 48 | 39.3 | 388 |
| | 3 | 16 | 83 | 38.1 | 387 |
| | 4 | 33 | 230 | 40.1 | 389 |
| | 5 | 32 | 225 | 40.0 | 387 |
| | 6 | 35 | 237 | 40.4 | 391 |
| | 7 | 36 | 250 | 40.6 | 389 |
| | 8 | 34 | 231 | 40.2 | 390 |
| | 9 | 33 | 220 | 40.1 | 391 |
| | 10 | 31 | 200 | 39.7 | 387 |
| | 11 | 25 | 62 | 39.2 | 389 |
| | 12 | 13 | 40 | 38.8 | 387 |
| Extruded aluminum alloy for comparison | 13 | 52 | 426 | 43.6 | 397 |
| | 14 | 42 | 203 | 43.2 | 394 |
| | 15 | 54 | 418 | 43.8 | 396 |
| | 16 | 7 | 17 | 37.5 | 379 |
| | 17 | 5 | 5 | 35.0 | 410 |

EXTRUDED ALUMINUM ALLOY WHICH EXCELS IN MACHINABILITY, CAULKING PROPERTIES, AND WEAR RESISTANCE

CROSS REFERENCE TO RELATED APPLICATION

This application is a continuation of International Application No. PCT/JP03/11167, having an international filing date of Sep. 1, 2003, which designated the United States, the entirety of which is incorporated herein by reference.

BACKGROUND OF THE INVENTION

The present invention relates to high-strength wear-resistant extruded aluminum alloy which excels in machinability during machining and caulking properties (or toughness).

The Japanese Industrial Standards define various types of aluminum alloy. A 4000 series alloy exhibits comparatively high wear resistance by adding Si to aluminum and causing hard Si particles to disperse and precipitate in the metallographic structure.

However, if a large number of hard Si particles exist in the metallographic structure, toughness of the metal material is decreased due to a notch effect originating from the Si particles.

The Si particles have the effect of dispersing chips during machining, but may cause the surface roughness of the machined surface to be decreased.

In the case of applying extruded aluminum alloy to automotive brake parts or the like, in addition to wear resistance against sliding parts, high machining accuracy and caulking accuracy are generally required.

In the case of manufacturing parts for an automotive antilock braking system actuator body (hereinafter called "ABS body"), a cylinder section including a piston and valve parts, a hydraulic circuit groove, and the like are subjected to machining, and a caulking seal or the like is provided after assembling the parts.

Therefore, not only the strength, but also wear resistance against sliding parts, machinability into a complicated shape, and pressure resistance of the caulking section against hydraulic oil or the like are required.

A further reduction in the size and weight of the ABS body has been demanded accompanying a reduction in the weight of automobiles. However, extruded aluminum alloy which can deal with such a demand has not been proposed.

SUMMARY

According to a first aspect of the invention, there is provided extruded aluminum alloy which excels in machinability, caulking properties, and wear resistance, the extruded aluminum alloy comprising 3.0 to 6.0 mass % of Si, 0.1 to 0.45 mass % of Mg, 0.01 to 0.5 mass % of Cu, 0.01 to 0.5 mass % of Mn, and 0.40 to 0.90 mass % of Fe, with the balance being Al and unavoidable impurities.

According to a second aspect of the invention, there is provided extruded aluminum alloy which excels in machinability, caulking properties, and wear resistance, the extruded aluminum alloy comprising 4.1 to 5.1 mass % of Si, 0.3 to 0.45 mass % of Mg, 0.10 to 0.20 mass % of Cu, 0.05 to 0.15 mass % of Mn, and 0.40 to 0.90 mass % of Fe, with the balance being Al and unavoidable impurities.

According to a third aspect of the invention, there is provided extruded aluminum alloy which excels in machinability, caulking properties, and wear resistance, the extruded aluminum alloy comprising 4.1 to 5.1 mass % of Si, 0.3 to 0.45 mass % of Mg, 0.10 to 0.20 mass % of Cu, 0.05 to 0.15 mass % of Mn, 0.01 to 0.5 mass % of Cr, and 0.40 to 0.90 mass % of Fe, with the balance being Al and unavoidable impurities.

According to a fourth aspect of the invention, there is provided extruded aluminum alloy which excels in machinability, caulking properties, and wear resistance, the extruded aluminum alloy comprising 4.1 to 5.1 mass % of Si, 0.3 to 0.4 (excluding 0.4) mass % of Mg, 0.10 to 0.20 mass % of Cu, 0.05 to 0.15 mass % of Mn, 0.01 to 0.5 mass % of Cr. and 0.40 to 0.90 mass % of Fe, with the balance being Al and unavoidable impurities.

According to a fifth aspect of the invention, there is provided extruded aluminum alloy which excels in machinability, caulking properties, and wear resistance, the extruded aluminum alloy comprising 4.1 to 5.1 mass % of Si, 0.3 to 0.4 (excluding 0.4) mass % of Mg, 0.10 to 0.20 mass % of Cu, 0.05 to 0.15 mass % of Mn, 0.01 to 0.5 mass % of Cr, and 0.50 to 0.90 (excluding 0.50) mass % of Fe, with the balance being Al and unavoidable impurities.

Although wear resistance, strength, and hardness have been considered to be in conflict with caulking properties (or toughness) in related-art wear resistant materials, the extruded aluminum alloy according to the invention not only exhibits all these properties, but also excels in these properties in comparison with the related-art wear-resistant materials. Therefore, the extruded aluminum alloy according to the invention may be utilized for a product required to excel in pressure resistance, caulking properties, and machinability.

BRIEF DESCRIPTION OF THE SEVERAL VIEWS OF THE DRAWING

FIG. 1 is a table showing components added to extruded aluminum alloy according to the invention and extruded aluminum alloy for comparison.

FIG. 2 is a table showing artificial aging conditions and mechanical properties of the extruded aluminum alloy according to the invention and the extruded aluminum alloy for comparison.

FIG. 3 is a table showing evaluation results for machinability and caulking properties of the extruded aluminum alloy according to the invention and the extruded aluminum alloy for comparison.

DETAILED DESCRIPTION OF THE EMBODIMENT

Figure 4:
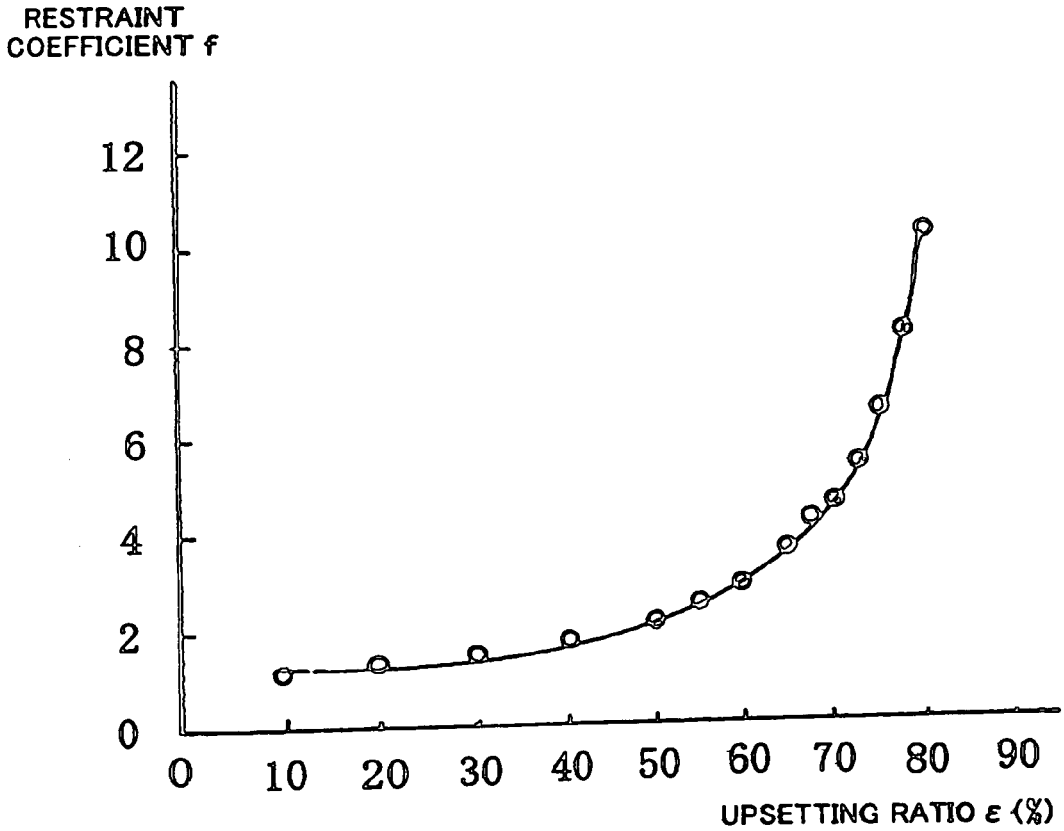
FIG. 4 is a graph showing the relationship between an upsetting ratio $\epsilon$ and a restraint coefficient f.

Embodiments of the invention may provide extruded aluminum alloy effective for improving strength, wear resistance, machinability, and caulking properties which are considered to have a negative correlation.

According to one embodiment of the present invention, there is provided extruded aluminum alloy which excels in machinability, caulking properties, and wear resistance, the extruded aluminum alloy comprising 3.0 to 6.0 mass % of Si, 0.1 to 0.45 mass % of Mg, 0.01 to 0.5 mass % of Cu, 0.01 to 0.5 mass % of Mn, and 0.40 to 0.90 mass % of Fe, with the balance being Al and unavoidable impurities. ("mass %" is hereinafter simply indicated as "%").

The Si content is set at 3.0 to 6.0% and the Mg content is set at 0.1 to 0.45% in order to obtain strength due to age hardening by causing Si and Mg to precipitate as $Mg_2Si$ and to secure wear resistance due to the presence of Si particles.

Since Si forms $Mg_2Si$ together with Mg, Si particles contributing to wear resistance are significantly affected by the amount of Mg added.

Therefore, it is preferable to control the Mg content in the range of 0.3 to 0.45%, and ideally in the range of 0.3 to 0.4 (excluding 0.4) % in order to stabilize strength and wear resistance of the extruded aluminum alloy.

The strength of the extruded aluminum alloy can be stabilized at a relatively high level and Si particles contributing to wear resistance can be easily controlled by controlling the Mg content in such a narrow range. The wear resistance is stabilized by controlling the Si content in the range of 4.1 to 5.1%.

Si and Mg have a positive effect on strength due to the precipitation effect of $Mg_2Si$, but have a considerable negative effect on caulking properties.

Therefore, the Mg content must be 0.1% or more from the viewpoint of strength, and is preferably 0.3% or more from the viewpoint of stability. In order to ensure caulking properties (or toughness), the Mg content is preferably 0.45% or less, and ideally less than 0.4%.

It is preferable to add Cu in an amount of 0.01 to 0.5% as a means for improving strength while ensuring caulking properties.

Since Cu is dissolved to some extent, strength and machinability are improved due to the solid solution effect.

In the case where strength is insufficient to some extent in comparison with desired material strength by limiting the Mg content to 0.45% or less in order to ensure caulking properties, the addition of Cu is expected to exert an effect.

However, since potential difference corrosion may occur if the amount of Cu added is increased, it is preferable to control the Cu content in the range of 0.10 to 0.20%.

Mn has the effect of refining the crystal grains of the extruded aluminum alloy, and is preferably added in an amount of 0.01 to 0.5% from the viewpoint of improvement of machinability.

However, since Mn may cause potential difference corrosion and decrease caulking properties when precipitated at the grain boundaries, it is preferable to control the Mn content in the range of 0.05 to 0.15%.

A specific feature of this embodiment is to control the Fe content.

Fe in extruded aluminum alloy is generally considered to be an impurity.

It has been confirmed that Fe has a crystal grain refinement effect.

However, a thorough examination on the effect of Fe on caulking properties has not yet been reported.

The inventors of the invention tested and evaluated samples of extruded aluminum alloy in which the Fe content was changed to some extent. As a result, it was found that caulking properties of extruded aluminum alloy are decreased when Fe is added in an amount exceeding 0.9%, and that machinability is improved while maintaining caulking properties by controlling the Fe content in the range of 0.40 to 0.90%.

If the amount of Fe added is less than 0.4%, machinability is not improved. It is ideal to control the Fe content to be more than 0.50% but equal to or less than exceed 0.90%.

As a result of metallographic observation, it is estimated that Fe particles are dispersed at the grain boundaries and chips produced during machining easily break at the Fe particles, whereby machinability is improved.

Therefore, the reason that caulking properties (elongation) are adversely affected when Fe is added in an amount exceeding 0.9% is because a large amount of Fe precipitates at the grain boundaries.

Therefore, since artificial aging treatment conditions after a solution treatment of extruded aluminum alloy affect caulking properties and machinability, overaging conditions which allow the maximum strength to be exceeded to some extent are preferable.

Cr has a crystal grain refinement effect and is arbitrarily added. If the Cr content exceeds 0.5%, Cr may produce a large primary crystal product to decrease caulking properties. Therefore, it is preferable to control the Cr content in the range of 0.01 to 0.5%.

Ti also has a crystal grain refinement effect, and improves machinability if the amount of addition is small.

However, if the amount of Ti added exceeds 0.1%, the life of a cutting tool is decreased. Therefore, the Ti content is controlled in the range of 0.01 to 0. 1%.

A table shown in FIG. 1 indicates components (%) added to extruded aluminum alloy according to the invention and to extruded aluminum alloy for comparison. The remaining components (%) which are not shown in the table are aluminum and unavoidable impurities.

An 8-inch billet having the alloy composition shown in FIG. 1 was cast, and subjected to a homogenization treatment at 460 to 590° C. for six hours or more.

The resulting billet was preheated to 450 to 510° C. and extruded into quadrilateral extruded aluminum alloy samples with dimensions of about 35×80 mm.

As the heat treatment, a solution treatment and an artificial aging treatment are performed. As the solution treatment method, the extruded product may be heated after extrusion and then rapidly cooled. In this embodiment, the extruded product was rapidly quenched immediately after extrusion in the vicinity of the extrusion die, and was subjected to a tempering treatment by predetermined artificial aging.

FIG. 2 shows the artificial aging conditions. In FIG. 2, the unit of the temperature in the column for aging is "° C.".

For example, an extruded aluminum alloy sample No. 1 was subjected to the artificial aging treatment at 185° C. for four hours. As the aging treatment conditions, conditions which allow the material to exhibit approximately the maximum tensile strength are indicated as "stable", "under-aging" means that the heat treatment was terminated in a state in which the original maximum tensile strength of the material was not reached, and "overaging" means that the heat treatment was performed until the original maximum tensile strength of the material was exceeded to some extent.

FIG. 2 shows the measurement results for tensile strength in the extrusion direction, 0.2% yield strength, and Rockwell B scale (HRB) hardness of a surface of each sample.

As the evaluation of caulking properties (or toughness), FIG. 2 shows "elongation" in the extrusion direction, and FIG. 3 shows the critical upsetting ratio and the mean deformation resistance.

When a test specimen with a diameter of 14 mm and a height of 21 mm is collected from each sample in the extrusion direction and subjected to cold upsetting press in the axial direction, the critical upsetting ratio refers to the upsetting ratio at which microcracks start to occur in the side surface.

The critical upsetting ratio was calculated according to the following equation.

$$\epsilon hc=(h0-hc)/h0\times 100$$

ϵhc: critical upsetting ratio (%)

h0: original height of test specimen hc: height of test specimen when cracks occur The test was conducted at room temperature and a compression speed of 10 mm/s, and an autograph (25 t) was used as the test instrument.

The mean deformation resistance refers to the deformation resistance of the aluminum alloy when cracks occur in the side surface of the test specimen, and was calculated according to the following equation.

$$\sigma(hc)=(P/A0)/f(N/mm^2)$$

σ(hc): mean deformation resistance

P: upsetting load when cracks occur

A0: initial cross-sectional area of test specimen f: restraint coefficient at critical upsetting ratio f(ϵ(hc)) was determined from the graph shown in FIG. 4.

As the evaluation of machinability, FIG. 3 shows the "maximum chip length" and the "long chip total length".

The maximum chip length refers to the length of the longest chip among chips produced under the following test conditions, and the long chip total length refers to the sum of the lengths of long chips produced.

Machining Test Conditions

Cutting tool: step drill with diameter of 4.2×6.8

Rotational speed: 1200 rpm

Feed: 0.05 mm/rev

Processing amount: 15 mm

Number of processed holes: 3

Cutting oil: used

The components of the extruded aluminum alloy samples shown in FIG. 1 and the evaluation results (FIGS. 2 and 3) based on the components are considered below.

In the extruded aluminum alloy samples 1, 2, and 3, the Fe content was increased to 0.38%, 0.68%, and 0.92%, respectively. When comparing the samples 1, 2, and 3 with the comparative extruded aluminum alloy samples 15 (Fe: 0.29%), 16 (Fe: 1.20%), and 17 (Fe: 1.50%), the sample 15 had an excellent elongation of 9.4%, but exhibited poor machinability due to an increased chip length.

The comparative samples 16 and 17 exhibited excellent machinability due to a small chip length, but had poor elongation of 7.2% and 5.4%, respectively.

The comparative samples 16 and 17 also exhibited a low critical upsetting ratio.

When comparing the samples 1 and 2, although the difference in the elongation, critical upsetting ratio, and, in particular, mean deformation resistance is small, the difference in the chip length is large. This suggests that machinability can be improved while ensuring caulking properties when the Fe content is more than 0.38%.

When comparing caulking properties (elongation, critical upsetting ratio, and mean deformation resistance) and machinability (maximum chip length and long chip total length) for the samples 4 to 10 while paying attention to the change in the Fe content and the change in the Mg content, the samples 7, 8, 9, and 10, in which the Mg content was the same value of 0.39% and the Fe content was increased in units of about 0.05%, showed almost no difference in tensile strength and critical upsetting ratio and exhibited excellent machinability.

When comparing the samples 4, 5, and 6, in which the Fe content was almost the same value of about 0.5% and the Mg content was increased to 0.31%, 0.35%, and 0.44%, the tensile strength and the yield strength were improved without affecting the chip length and the critical upsetting ratio to a large extent.

Therefore, it was found that it is preferable that the Mg content be in the range of 0.3 to 0.45% and the Fe content be in the range of 0.40 to 0.90% in order to ensure stable strength and to improve machinability and caulking properties.

In order to further stabilize strength and improve machinability while maintaining excellent caulking properties, it is ideal to control the Mg content in the range of 0.3% or more, but less than 0.4% and the Fe content in the range of more than 0.5%, but 0.90% or less.

The samples 11 and 12 and the comparative samples 13 and the 14 were provided to compare the effect of age hardening.

The chip length can be decreased while maintaining the critical upsetting ratio and the mean deformation resistance to be almost the same, specifically, without sacrificing caulking properties by increasing the heat treatment temperature to allow overaging to occur to some extent, whereby machinability can be improved.

Under the overaging conditions shown in FIG. 2, the tempering temperature was increased. However, overaging may be allowed to occur by increasing the heat treatment time.

In the samples 1 to 12, since the Si content was controlled in the range of 4.1 to 5.1% within the range of 3.0 to 6.0%, the evaluation results are omitted. The samples 1 to 12 exhibited stable wear resistance.

A comparatively high strength was stably obtained by adding Cu in the range of 0.10 to 0.20%.

The addition of Mn in the range of 0.05 to 0.15% contributes to improvement of machinability.

Although only some embodiments of the present invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. Extruded aluminum alloy which excels in machinability, caulking properties, and wear resistance, the extruded aluminum alloy comprising 4.1 to 5.1 mass % of Si, 0.3 to 0.4 (excluding 0.4)mass % of Mg, 0.01 to 0.20 mass % of Cu, 0.05 to 0.15 mass % of Mn, 0.01 to 0.50 mass % of Cr, and 0.29 to 0.90 (excluding 0.29) mass % of Fe, with the balance being Al and unavoidable impurities, wherein an elongation is greater than or equal to 9.0% and the maximum chip length is less than or equal to 40 mm.

2. The extruded aluminum alloy as defined in claim 1, the extruded aluminum alloy being subjected to extrusion, a solution treatment, and an overaging treatment.

* * * * *